US006317929B1

(12) United States Patent
Ring

(10) Patent No.: US 6,317,929 B1
(45) Date of Patent: Nov. 20, 2001

(54) WINDOW HINGE

(75) Inventor: Donal Ring, Mallow (IL)

(73) Assignee: Jurras Limited (IL)

( * ) Notice: Subject to any disclaimer, the term of this patent is extended or adjusted under 35 U.S.C. 154(b) by 0 days.

(21) Appl. No.: 09/623,354

(22) PCT Filed: Mar. 3, 1999

(86) PCT No.: PCT/GB99/00638

§ 371 Date: Sep. 1, 2000

§ 102(e) Date: Sep. 1, 2000

(87) PCT Pub. No.: WO99/45222

PCT Pub. Date: Sep. 10, 1999

(30) Foreign Application Priority Data

Mar. 5, 1998 (IL) ..... 980159

(51) Int. Cl.[7] ..... E05D 1/04
(52) U.S. Cl. ..... 16/355; 16/362
(58) Field of Search ..... 16/355, 362, 358, 16/359, 357, 368; 49/375, 398, 399; 312/328

(56) References Cited

U.S. PATENT DOCUMENTS 47,092 * 4/1865 Dailey ..... 16/355
375,394 * 12/1887 Strachan ..... 16/355
819,098 * 5/1906 Underhill ..... 16/355
1,648,781 * 11/1927 Pepin ..... 16/355
2,056,805 * 10/1936 Reichard ..... 16/355
2,770,834 * 11/1956 Jannace ..... 16/355
3,027,592 * 4/1962 Schnur ..... 16/355
5,061,023 * 10/1991 Soubliere ..... 16/355
5,946,774 * 9/1999 Ramsey et al. ..... 16/355

* cited by examiner

*Primary Examiner*—Chuck Y. Mah
(74) *Attorney, Agent, or Firm*—Andrus, Sceales, Starke & Sawall

(57) ABSTRACT

A friction window hinge comprises a frame plate (15) for attachment to the fixed window frame (12), a vent plate (27) for attachment to the movable window vent (11), and a separate curved link (19) which extends between the plates and is slideably engageable with correspondingly curved guide tracks (17, 28) on both of the plates. In the open position the curved link (19) is extended between the plates (15, 27) to support the window vent, while in the closed position the plates are brought into overlying relation with the link retracted between them. The arrangement allows the vent to be swung to the fully open position without the hinged side of the vent significantly obstmcting access through the aperture in the fixed frame.

18 Claims, 2 Drawing Sheets

Figure 4:
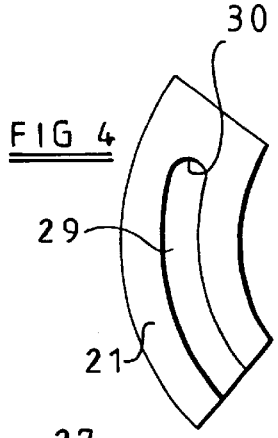

FIG 1
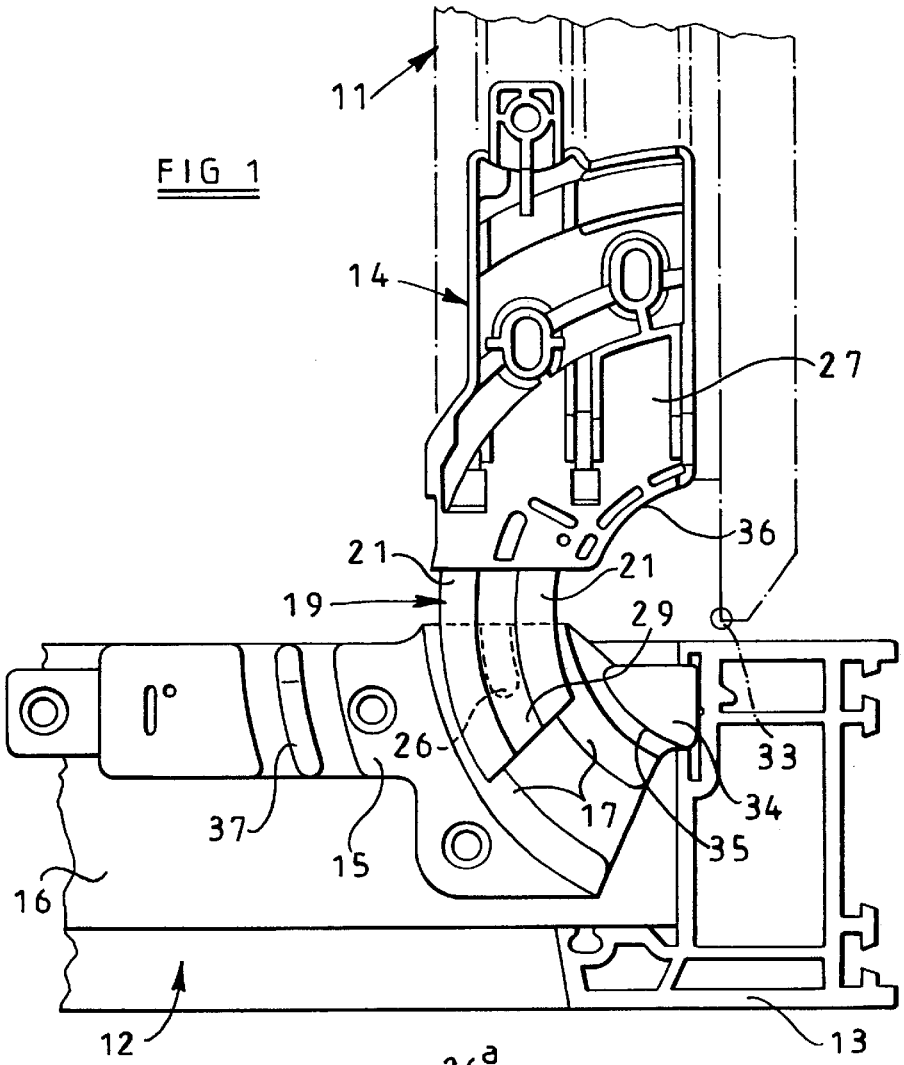
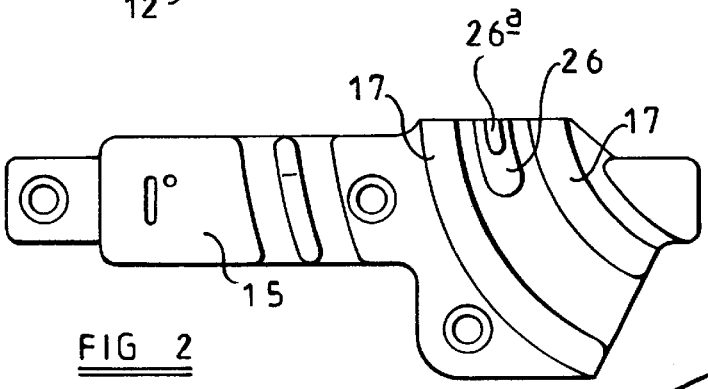
FIG 2
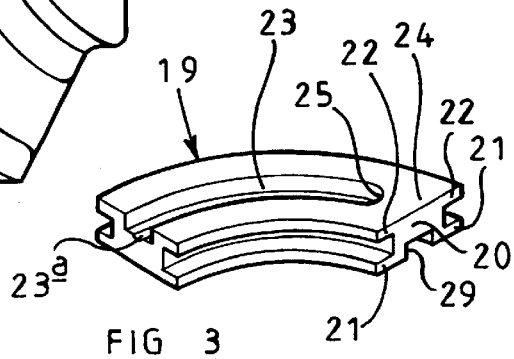
FIG 3

WINDOW HINGE

The invention relates to hinges and in particular to friction hinges for windows, A common friction hinge for aluminium or UPVC windows comprises a linkage having a track for fitting to the fixed window frame, a vent arm for fitting to the movable window vent, a slider slideable along the track, a link pivotally connected at one end to the slider and at its other end to the vent arm, and a control arm pivotally connected at one end to the track and at its other end to the vent arm. The link arrangement is such that the vent arm is movable between a closed position where it overlies the track and an open position where it extends at an angle to the track, such movement being accompanied by frictionally restrained movement of the slider along the track.

Normally, two such hinges are provided at opposite sides of the window and the geometry of the hinges is such that as the window vent pivots on the hinges the effective pivot axis of the vent is spaced from the fixed window frame. Accordingly, as the window opens, the frame member of the window vent which is nearest the hinge axis moves inwardly, partly across the window opening, with respect to the adjacent fixed frame member.

This arrangement has the advantage that, when the window is fully open, the person inside the building has access to both sides of the vent for cleaning purposes. However, the movement of the vent frame member partly across the window opening, and away from the adjacent fixed frame member has the effect of reducing the size of the main window opening in order to provide a narrow opening to the other side of the vent frame member for access to the outer surface of the vent.

For safety reasons, government regulations may specify minimum dimensions for the access aperture provided by a window when in a fully opened condition. However, aluminium and UPVC framed window assemblies are commonly provided in only a comparatively limited number of dimensions, partly for aesthetic reasons, but mainly because of the advantages provided by standardisation of window dimensions. Such standardisation reduces costs and facilitates the installation of windows in new buildings as well as their subsequent replacement. Standardisation also facilitates the manufacture and supply of window accessories which may, again, be of a limited number of standard dimensions.

The situation may, however, arise where a window assembly of a standard dimension, and having friction hinges of the kind referred to above, may not provide an access aperture, when fully open, which is sufficiently large to comply with prevailing regulations. In order to meet this problem, manufacturers of friction link hinges of the kind described above may supply a modified "access" hinge where certain links of the hinge may be disengaged from one another to allow wider than normal opening of the window in an emergency. However, such hinges are usually more complex in structure than the standard hinges and more costly to manufacture. Also, in an emergency a person wishing to increase the window opening in order to climb through it must be familiar with the manner in which the hinges may be disengaged to increase the size of the opening, and this may not always be the case. Also, there may be a risk of the hinges becoming accidentally disengaged during normal use, which may be undesirable.

Theoretically, the problem could be solved by mounting the window vent to the fixed frame by traditional butt hinges where the adjacent frame members of the vent and fixed frame remain close to one another as the window is opened. However, it is not practically possible to fit traditional butt hinges to aluminium and UPVC window assemblies of the kinds now commonly in use, due to the configuration of the extruded frame members which are used in such assemblies.

The present invention sets out to provide an improved form of window hinge which may provide, when the window is fully opened, an access aperture through the window which is equivalent to, or only slightly less than, the full size of the aperture in the fixed window frame, such hinge being particularly suitable for use with aluminium and UPVC framed window assemblies.

According to the invention there is provided a window hinge comprising a first guide having means for attachment to a fixed window frame, a second guide having means for attachment to a movable window vent, and a link which is engageable with both said guides and is slideable relatively to each guide.

Preferably the link comprises a single substantially rigid element, but the invention does not exclude arrangements where the link is formed in two or more relatively movable parts so as to be extensible. For example, the parts may be longitudinally slideable with respect to one another.

At least one of said guides, and preferably each said guide, comprises a track along which the link slides. Preferably the orientation of the link relative to the guide is determined by its position along said track.

The track may be curved, e.g. it may be part-circular. The link may frictionally engage the track so as to provide some frictional restraint to opening and closing of the window vent, in use, provided that the link can slide smoothly and without jamming. Preferably the link is formed from metal, but it might also be formed from resilient material, such as a resilient plastics. However, for greater strength a metal link is preferred.

Preferably stop means are provided between the link and the guide or guides to limit the relative sliding movement between the link and the guide or guides in at least one direction. Said means may comprise inter-engageable abutments on the link and guide or guides.

The track may comprise two generally parallel spaced guide surfaces between which at least a part of the link is slideably received. For example, the guide surfaces may comprise spaced grooves directed inwardly towards one another and engageable respectively with spaced outwardly directed flanges formed on the link.

In the case where a track comprising spaced flanges is formed on each guide, the link may be formed, at each side thereof, with a pair of spaced parallel outwardly directed flanges for engagement within the track grooves of the first and second guides respectively.

Each guide may comprise a base plate, each groove on the guide being provided by a generally L-sectioned rail upstanding from the base plate.

Figure 5:
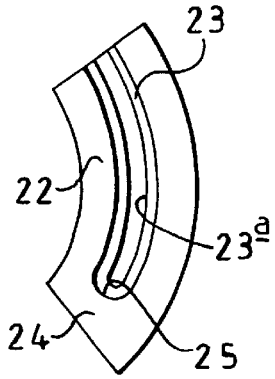
Figure 6:
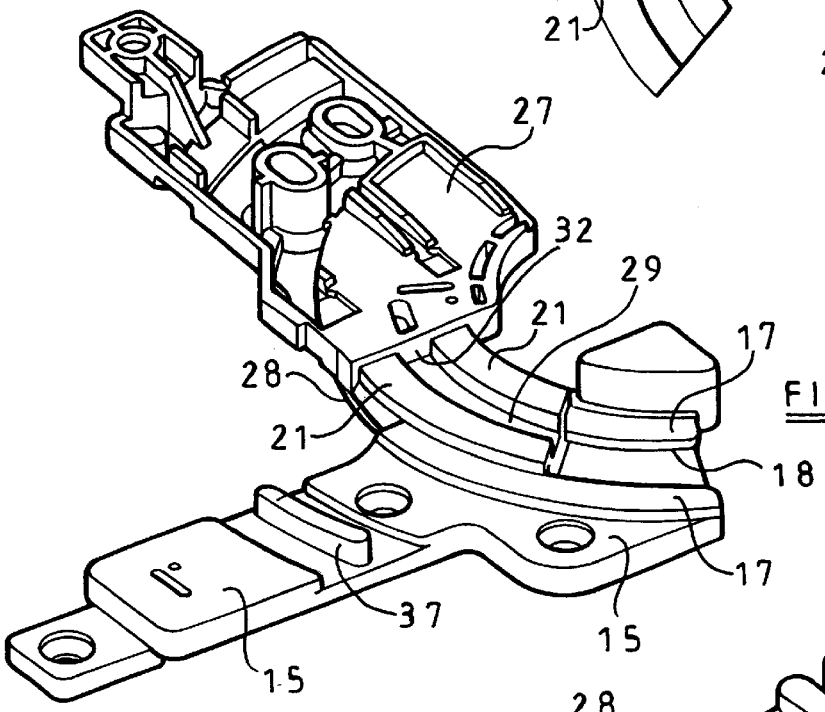
Figure 7:
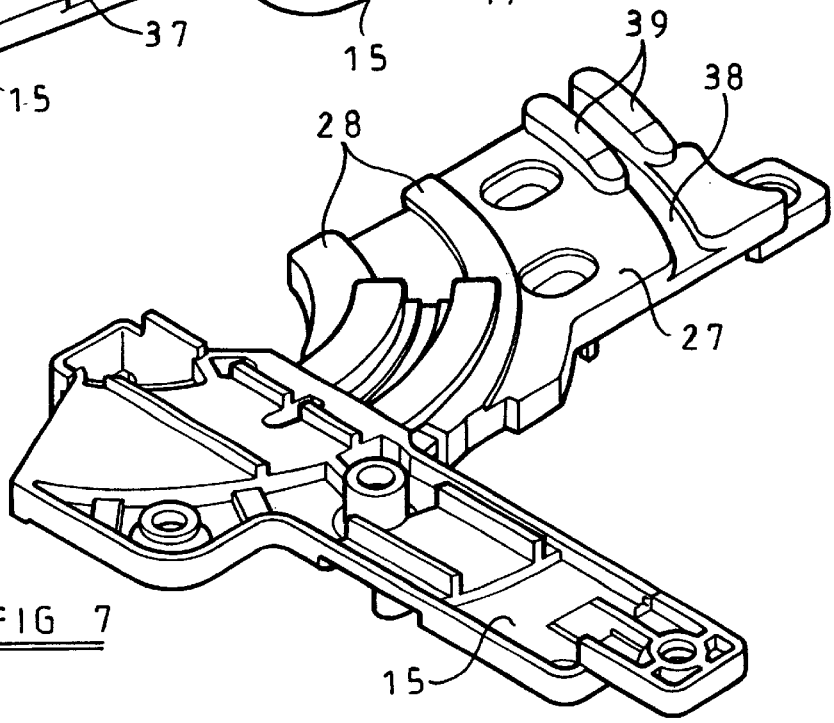

The following is a more detailed description of a preferred embodiment of the invention, by way of example, reference being made to the accompanying drawings in which:

FIG. 1 is a diagrammatic view from above of a friction hinge in accordance with the present invention, the hinge being shown in the open position, FIG. 2 is a view from above of the frame plate of the hinge, FIG. 3 is a perspective view of the curved link of the hinge (shown inverted), FIG. 4 is a top view of the curved link, FIG. 5 is an underside view of the curved link, FIG. 6 is a perspective view of the hinge in the open position, seen from above, and FIG. 7 is a perspective view of the hinge in the open position, seen from below.

Referring to FIG. 1: two hinges according to the present invention mount a rectangular window vent 11 to the side of a corresponding rectangular fixed window frame 12. The vent is side hung, that is to say it is supported by upper and lower hinges disposed at the upper and lower ends of a vertical side frame member 13 of the fixed window frame 12, although the hinges may also be used in top hung arrangements. FIG. 1 is a view from above of the lower hinge 14 with the vent 11 in the fully 90° open position. The upper hinge (not shown) is a mirror image of the lower hinge 14.

The frame plate 15 of the lower hinge 14 is screwed to the horizontal bottom frame member 16 of the fixed frame 12 adjacent the corner between the bottom frame member 16 and the vertical side frame member 13.

The frame plate 15, which may be die cast from suitable metal, such as a zinc alloy, is formed with two parallel part-circular flanges 17. As best seen in FIG. 6 the flanges 17 are of inverted L-shape in cross-section so as to provide inwardly facing grooves 18 between the flanges 17 and the frame plate 15.

A curved link 19, which also may be die cast from a zinc alloy, slideably engages the flanges 17, the flanges 17 and the link 19 being of corresponding radii of curvature. As may be seen from FIG. 3, the link 19 has a central longitudinal web 20 the opposite side edges of which are integrally formed with C-sectioned formations to provide upper outwardly projecting flanges 21 and spaced parallel lower flanges 22. (The link 19 is shown inverted in FIG. 3.) In FIGS. 1 and 6, the flanges 22 of the link 19 are lowermost and are slideably received in the grooves 18 on the frame plate 15. The underside of the link 19 is formed with a central longitudinal groove 23, which slides over an abutment 26 (see FIGS. 1 and 2) which upstands from the frame plate 15 between the outer ends of the flanges 17 on the plate.

In order to limit the outward sliding movement of the link 19 along the flanges 17, the groove 23 in the underside of the link 19 is closed at one end, as best seen in FIG. 5, so as to provide an end abutment surface 25 which engages with the upstanding projection 26 integrally formed on the frame plate 15.

The link 19 also slideably engages guide flanges on the underside of a die cast metal vent plate 27 which is screwed to the underside of the lower horizontal rail of the vent frame 11. The construction of the vent plate 27 is best seen in FIG. 7 which shows the underside of the vent plate 27.

As may be seen from FIG. 7, the underside of the vent plate 27 is integrally formed with spaced curved L-sectioned flanges 28 which are of similar cross-section to he flanges 17 on the frame plate 15. In this case the upper side flanges 21 of the link 19 engage within the inwardly facing grooves provided by the flanges 28 on the underside of the vent plate 27. Again, as may best be seen from FIG. 4, one end of the upper groove 29 in the link 19 is closed to provide an end abutment surface 30 which engages an abutment 32 on the vent plate 27 (see FIG. 6), between the flanges 28, to limit the sliding movement of the link 19 with respect to the vent plate 27 and prevent it becoming detached from the vent plate.

In order to assemble the three components of the hinge, the link 19 is first connected to the lower frame plate 15 by sliding the flanges 22 of the link beneath the flanges 17 of the frame plate 15. The open end of the groove 23 in the underside of the link 19 slides over the abutment 26 on the frame plate 15 until the closed end 25 of the groove strikes the abutment 26. The link 19 is then in the position shown in FIG. 1.

In order to prevent the link being fitted to the frame plate 15 in the inverted orientation, the abutment 26 is formed with a smaller upstanding abutment **26*a* (see FIG. 2) over which slides a narrower groove 23*a* (see FIG. 5) formed in the bottom wall of the groove 23. The groove 29 on the upper side link 19 does not have such a smaller auxiliary groove in its bottom wall. Consequently, if an attempt is made to introduce the link 19 between the flanges 17 in an inverted orientation, i.e. with the flanges 21 lowermost, the groove 29 will begin to slide over the abutment 26 but it will not be able to move further than the auxiliary abutment 26*a* since that abutment will be engaged by the leading end of the link, thus preventing the link being moved to the position shown in FIG. 1**.

After the link 19 has been correctly fitted to the frame plate 15, the vent plate 27 is connected to the link 19 by passing the flanges 28 on the underside of the vent plate 27 beneath the flanges 21 on the link, the vent plate 27 being slid along the link 19 (clockwise in FIG. 1) until the abutment 32 on the underside of the vent plate 27 engages the closed end 30 of the groove 29 in the link, in the position shown in FIG. 1.

Referring again to FIG. 1, the window vent 11 is thus supported by the curved sliding links 19 of the lower and upper hinges which permit the vent 11 to swing outwardly from the fixed frame 12 to the open position shown in FIG. 1. The effective pivot axis of the hinges, indicated at 33 in FIG. 1, is defined by the common centre of curvature of the flanges 17, the link 19 and the flanges 28.

As may be seen from FIG. 1, the geometry of the hinges is such that the vent 11 overlaps by only a small amount the aperture defined by the frame members 13 of the fixed frame when the window vent is in the fully open position, thus providing an access aperture which is only very slightly narrower than the aperture in the fixed frame 12. This enables the access aperture required by regulations to be achieved with standard sizes of fixed window frame. When the window is in the closed position, with the vent 11 lying within the fixed frame 12, the sash plate 27 overlies the frame plate 15 with the link 19 between them.

The end of the frame plate 15 nearest the pivot point 33 is integrally formed with an upstanding block 34 which is of generally triangular form, having a convexly curved edge 35 which fits within a concavely curved edge surface 36 on the vent plate 27 when the window vent is closed and the plate 27 overlies the plate 15. The purpose of the block 34 is to prevent the insertion of a screwdriver, jemmy or similar implement between the two plates 15 and 27 from outside the window for the purpose of breaking the hinge and thereby being able to obtain unauthorized entry through the window.

Also, the frame plate 15 is formed with an arcuate upstanding rib 37 which is centred on the pivot axis 33 of the hinge. As the window vent is moved into the closed position, the rib 37 slides along a groove 38 formed in the underside of the vent plate 27. When the window is fully closed, and the vent plate 27 overlies the frame plate 15, the upstanding rib 37 on the frame plate lies between two downwardly projecting ribs 39 integrally formed on the underside of the vent plate 27, on opposite sides of the groove 38. The location of the rib 37 between the ribs 39 provides resistance to attempts to break the hinge by trying to lever the closed vent away from the upright 13 i.e. to the left in FIG. 1.

In order to provide additional security and strength when the window vent is open, an adjustable stay may be provided extending from the upper horizontal member of the vent to the upper horizontal member of the fixed frame. For example, one end of the stay may be pivotably connected to the vent, the opposite end of the stay carrying a slider which is slideable along a track mounted on the fixed frame member. For example, the track may be in the form of a channel-shaped member along which is slideable a friction pad to which the end of the stay is connected. Means such as a screw device may be provided on the slider for engagement with the track in order to vary the resistance to sliding of the slider along the track and/or to lock the slider in a desired position along the track so as to hold the window open at a desired angle. There may be mounted on the track a disengageable catch which is normally engageable by the slider to limit the angle of opening of the window vent. Release of the catch allows the slider to travel further along the track so that the window may be fully opened when required. The catch may be of the child-proof type in order to prevent a child from opening the window beyond a predetermined small amount, for safety reasons.

Although the adjustable stay could be mounted at the bottom of the window if it includes a child-proof catch, positioning at the top of the window is preferred. This not only gives better access through the window opening in an emergency, but the stay then also acts as a safety device, should the upper hinge break, since the top of the window vent would then remain attached to the adjustable stay instead of toppling over and breaking free from the fixed frame.

In order to increase the frictional engagement between the link 19 and the flanges 17 and 28, the link 19 could be formed with a slight longitudinal twist. Bumps might also be formed in the surface of the link. Alternatively or additionally, there may be received in the web 20 of the link 29 a grub screw which bears against a small rectangular friction pad which is received in a rectangular recess on one side of the web 20 so that by turning the grub screw the pressure on the friction pad against the adjacent surface of the frame plate 15 or vent plate 27 may be adjusted.

In order to facilitate the assembly of the three parts 15, 19, 17 of each hinge, each face of the link 19 could be integrally formed with a small spring leg which snaps over a small abutment on the frame plate or vent plate as the link is first introduced into the flanges on the plate. The link 19 is thereby retained in engagement with the frame plate and vent plate so that its sliding movement is limited to movement between the abutments 26 and 32 and the small abutments with which the sprung legs engage.

As previously mentioned, the plates 15 and 27, and the link 19, may be die cast from metal, for example from a zinc alloy. In this case, the outer surface of the link 19 may be copper plated and then nickel plated for additional strength and smoothness of operation. Preferably the outer edges of the plates 15 and 27 in the vicinity of the abutments 26 and 32 respectively are smoothed to prevent these edges digging into the surface of the link 19 as the hinge is operated. If the edges on either plate were to dig into the surface of the link any further torque applied to the vent, in an attempt to close it, could result in damage and even fracture of the link and it is therefore important that the link 19 slides smoothly with respect to both the frame plate 15 and the vent plate 27.

Instead of the link and the two plates 15 and 27 being die cast, as described above, the link might be moulded, for example from a plastics material such as acetal resin. The invention is not limited to the components being formed from any particular material or manufactured by any particular process.

The hinge construction in accordance with the present invention and as described above may not only be stronger than the multi-link friction hinges of the kind previously described, but may also be cheaper to manufacture, since it comprises fewer parts and involves much less assembly work than conventional friction hinges.

Although the example shown has only a single one-piece link connected between the vent plate and frame plate, arrangements are also possible where the link comprises two or more extensible parts, for example two or more parts which are in slideable engagement with one another. Such arrangement may be advantageous where only limited space is available to receive the links when the window is in the closed position.

What is claimed is:

1. A window hinge comprising a first guide having means for attachment to a fixed window frame, a second guide having means for attachment to a movable window vent, and a link which is engageable with both said guides and is slidable relatively to each guide, wherein each guide is carried on a respective base plate which is substantially co-planar with the guide and extends laterally thereof, which base plates are substantially parallel to one another and move into overlying relationship to one another when the hinge is brought to its closed position.

2. A window hinge according to claim 1, wherein the base plates are provided with interengageable formations which interengage, when the base plates are in overlying relation, in a manner to restrain movement of one base plate relative to the other in a direction away from an effective pivot axis of the hinge.

3. A window hinge according to claim 2, wherein said interengageable formations comprise a first rib which extends from one base plate towards the other base plate and is interengagable with a second rib which extends from said other base plate towards said one base plate.

4. A window hinge according to claim 3, wherein the rib on one base plate projects between two spaced ribs on the other base plate, when the base plates are in overlying relation.

5. A window hinge according to claim 3, wherein said ribs are part-circular and concentric with the effective pivot axis of the hinge.

6. A window hinge according to claim 1, wherein at least one of the base plates is provided with a projecting formation which is slideable along a groove formed in the other base plate, said groove being concentric with an effective pivot axis of the hinge.

7. A window hinge according to claim 6, wherein said projecting formation is a part-circular rib which is concentric with the effective pivot axis of the hinge.

8. A window hinge according to claim 1, wherein at least one of the base plates is provided with a structure which extends across a region of the peripheral edge of the other base plate, when the base plates are in overlying relation, in a manner to prevent insertion of an implement between the base plates in said peripheral region.

9. A window hinge according to claim 1, wherein the link comprises a single substantially rigid element.

10. A window hinge according to claim 1, wherein each of said guides comprises a track along which the link slides.

11. A window hinge according to claim 10, wherein each track is part-circular.

12. A window hinge according to claim 10, wherein the link frictionally engages each track so as to provide some frictional restraint to opening and closing of the window vent, in use.

13. A window hinge according to claim 1, wherein the link and both guides are formed from metal.

14. A window hinge according to claim 13, wherein the link in nickel plated.

15. A window hinge according to claim 14, wherein the link is nickel plated on top of copper plating.

16. A window hinge according to claim 1, wherein the link and/or at least one of the guides is formed from resilient material.

17. A window hinge according to claim 1, wherein stop means are provided between the link and at least one of said guides to limit the relative sliding movement between the link and the guide in at least one direction.

18. A window hinge according to claim 17, wherein said stop means comprise projections on the guides which are slidable along respective closed-ended grooves in the link.

* * * * *

UNITED STATES PATENT AND TRADEMARK OFFICE

CERTIFICATE OF CORRECTION

PATENT NO. : 6,317,929 B1
DATED : November 20, 2001
INVENTOR(S) : Donal Ring

It is certified that error appears in the above-identified patent and that said Letters Patent is hereby corrected as shown below:

Title page,
Item [30], Foreign Application Priority Data,
Delete "(IL)" and substitute therefore -- (IE) --.

Signed and Sealed this

Twelfth Day of March, 2002

*Attest:*

*Attesting Officer*

JAMES E. ROGAN
*Director of the United States Patent and Trademark Office*